US010196764B2

(12) United States Patent
Asano

(10) Patent No.: US 10,196,764 B2
(45) Date of Patent: Feb. 5, 2019

(54) TEXTURED SPUN YARN AND WOVEN OR KNITTED FABRIC USING SAME

(71) Applicant: Asanonenshi Co., LTD., Anpachi-gun, Gifu (JP)

(72) Inventor: Masami Asano, Gifu (JP)

(73) Assignee: Asanonenshi Co., LTD., Anpachi-gun (JP)

( * ) Notice: Subject to any disclaimer, the term of this patent is extended or adjusted under 35 U.S.C. 154(b) by 1050 days.

(21) Appl. No.: 14/542,829

(22) Filed: Nov. 17, 2014

(65) Prior Publication Data

US 2015/0068000 A1 Mar. 12, 2015

Related U.S. Application Data

(63) Continuation of application No. PCT/JP2013/066029, filed on Jun. 11, 2013.

(30) Foreign Application Priority Data

Jul. 27, 2012 (JP) ..... 2012-167178

(51) Int. Cl.

| | |
|---|---|
| ***D02G 3/40*** | (2006.01) |
| ***D02G 3/26*** | (2006.01) |
| ***D06M 15/03*** | (2006.01) |
| ***D06M 15/11*** | (2006.01) |

(Continued)

(52) U.S. Cl.

CPC ..... *D02G 3/406* (2013.01); *D02G 3/26* (2013.01); *D02G 3/40* (2013.01); *D03D 15/00* (2013.01);

(Continued)

(58) Field of Classification Search

CPC ..... D02G 3/406; D02G 3/26; D02G 3/40; D03D 15/00; D04B 1/04; D04B 1/14;

(Continued)

(56) References Cited

U.S. PATENT DOCUMENTS 4,410,588 A * 10/1983 Ling ..... D06M 15/285 252/8.83
2007/0214765 A1 9/2007 Teshima
2013/0037163 A1 2/2013 Teshima

FOREIGN PATENT DOCUMENTS

CN 1643197 A 7/2005
JP 2000-119927 A 4/2000

(Continued)

OTHER PUBLICATIONS

International Search Report (in Japanese and English) corresponding to International Application No. PCT/JP2013/066029 dated Aug. 27, 2013.

(Continued)

*Primary Examiner* — Robert S Walters, Jr.
(74) *Attorney, Agent, or Firm* — Kenichiro Yoshida

(57) ABSTRACT

Provided are a textured spun yarn ($A_0$) obtained by twisting a starched and dried single spun yarn in the opposite direction to the twisting direction of the single spun yarn by the number of twists which is 1.3 to 3 times the number of twists of the single spun yarn, a textured spun yarn ($A_1$) obtained by removing a starch agent in water from the textured spun yarn, a woven or knitted fabric obtained by dissolving and removing the starch agent in water from a woven or knitted fabric manufactured using the textured spun yarn ($A_0$), and a woven or knitted fabric manufactured using the textured spun yarn ($A_1$), and methods of manufacturing them.

9 Claims, 3 Drawing Sheets

(51) Int. Cl.

| | |
|---|---|
| ***D06M 15/15*** | (2006.01) |
| ***D06M 15/333*** | (2006.01) |
| ***D04B 1/14*** | (2006.01) |
| ***D04B 1/04*** | (2006.01) |
| ***D03D 15/00*** | (2006.01) |

(52) U.S. Cl.
CPC ..... *D04B 1/04* (2013.01); *D04B 1/14* (2013.01); *D06M 15/03* (2013.01); *D06M 15/11* (2013.01); *D06M 15/15* (2013.01); *D06M 15/333* (2013.01); *D10B 2201/20* (2013.01)

(58) Field of Classification Search
CPC ..... D06M 15/03; D06M 15/11; D06M 15/15; D06M 15/333; D10B 2201/20
See application file for complete search history.

(56) References Cited

FOREIGN PATENT DOCUMENTS

| | | | |
|---|---|---|---|
| JP | 4393357 | B2 | 6/2006 |
| JP | 2008-25055 | A | 2/2008 |
| WO | 03/078709 | A1 | 9/2003 |
| WO | 2011/132708 | A1 | 10/2011 |

OTHER PUBLICATIONS

Extended European Search Report for corresponding International Application No. PCT/JP2013/066029 dated Mar. 9, 2016.
Chinese Office Action for corresponding Chinese Application No. 201380038271.x dated Mar. 16, 2016.

* cited by examiner

TEXTURED SPUN YARN AND WOVEN OR KNITTED FABRIC USING SAME

CROSS REFERENCE TO RELATED APPLICATIONS

This application is a continuation of International Application No. PCT/JP2013/066029 filed on Jun. 11, 2013, claiming priority upon Japanese Patent Application No. 2012-167178 filed Jul. 27, 2012 of which full contents are incorporated herein by reference.

BACKGROUND OF THE INVENTION

Field of the Invention

The present invention relates to a textured spun yarn for being weaved or knitted to manufacture a woven or knitted fabric, a woven or knitted fabric using the textured spun yarn, and a method of manufacturing the textured spun yarn and the woven or knitted fabric.

Description of the Related Art

Known has been a method of performing false twisting process and crimping process on a yarn and giving bulkiness thereto. This method is, however, limited to be applied to yarns using synthetic fibers such as polyester fibers, polyamide fibers, and acrylic fibers and is difficult to be applied to a yarn using cotton fibers, and the like.

Further, known has been the following methods of manufacturing a cellulosic fiber bulky yarn and a cellulosic fiber bulky woven or knitted fabric (see, Japanese Patent Application Laid-open No. 2000-119927). That is, a starching process is performed on a hard twist yarn formed by cellulosic fibers. Subsequently, it is treated with liquid ammonia, and then, with warm water, hot water, or steam. Thereafter, the hard twist yarn, is twisted with a water-soluble yarn together by reverse twisting by the number of twists half to twice the number of twists of the hard twist yarn so as to obtain a doubled yarn. After that, the water-soluble yarn in the doubled yarn is dissolved and removed so as to manufacture the cellulosic fiber bulky yarn. Further, a woven or knitted fabric is manufactured using the doubled yarn (doubled yarn before dissolving and removing the water-soluble yarn) obtained in the above-mentioned process and the water-soluble yarn in the woven or knitted fabric is dissolved and removed so as to manufacture the cellulosic fiber bulky woven or knitted fabric. These methods require an extremely large number of treatment processes of "starching process on the hard twist yarn, liquid ammonium treatment, warm or hot treatment (treatment with warm water, hot water, or steam), manufacturing of the doubled yarn by the reverse twisting with the water-soluble yarn, and dissolving and removing of the water-soluble yarn from the doubled yarn" in order to obtain the bulky yarn. Further, in order to obtain the bulky woven or knitted fabric, an extremely large number of treatment processes of "starching process on the hard twist yarn, liquid ammonium treatment, warm or hot treatment (treatment with warm water, hot water, or steam), manufacturing of the doubled yarn by the reverse twisting with the water-soluble yarn, manufacturing of the woven or knitted fabric using the doubled yarn, and dissolving and removing of the water-soluble yarn from the woven or knitted fabric" are required. This results in complexity of the processes and increase in time and effort. In addition, these methods arise problems that it take time to dissolve and remove the water-soluble yarn and it is difficult to provide sufficient bulkiness even when the water-soluble yarn is dissolved and removed because the water-soluble yarn is dissolved and removed in a state where the water-soluble yarn is constrained in the doubled yarn and the water-soluble yarn is dissolved and removed from the woven or knitted fabric in a state where the doubled yarn is constrained in the woven or knitted fabric. Further, these methods require usage of the hard twist yarn and the water-soluble yarn such as the polyvinyl alcohol fiber yarn, resulting in increase in the cost.

Under the above-mentioned circumstances, the present inventors have developed and applied a composite twisted yarn obtained by twisting a spun yarn and a water-soluble yarn together in the opposite direction to the twisting direction of the spun yarn and a woven or knitted fabric obtained by dissolving and removing the water-soluble yarn from a woven or knitted fabric in water after manufacturing the woven or knitted fabric using the composite twisted yarn (see, Japanese Patent No. 4393357 and Japanese Patent Application Laid-open No. 2008-25055). The woven or knitted fabric (woven or knitted fabric after dissolving and removing the water-soluble yarn) manufactured from the composite twisted yarn developed by the present inventors has excellent characteristics including preferable airy touch and texture and excellent characteristics in lightweight properties and air permeability. However, the composite twisted yarn has a problem that the cost is increased because the water-soluble yarn is used. Further, the inventors have further studied the composite twisted yarn and the woven or knitted fabric obtained using it. As a result, they have found that when twisting in the opposite direction to the twisting direction of the spun yarn for manufacturing the composite twisted yarn, the spun yarn itself is not sufficiently twisted reversely because of the presence of the water-soluble yarn and a bulking effect after removing the water-soluble yarn from the woven or knitted fabric manufactured using the composite twisted yarn is limited with the insufficient reverse twist in some cases.

SUMMARY OF THE INVENTION

An object of the present invention is to provide a textured spun yarn for manufacturing a woven or knitted fabric, which can manufacture a woven or knitted fabric that is lightweight with a large volume, is soft and excellent in touch, is excellent in heat-insulating properties and anti-pilling properties, is excellent in sustainability of these properties, sheds no fluff, and is excellent in water absorbency and rapid-drying properties, a woven or knitted fabric using the above textured spun yarn, and methods of manufacturing the above textured spun yarn and the woven or knitted fabric. Further, the invention can be effectively applied to both of a woven or knitted fabric manufacturing method using a yarn dyed in advance and a method in which a manufactured woven or knitted fabric is dyed. In any of these two cases, the invention provides a textured spun yarn for manufacturing a woven or knitted fabric, which can manufacture a woven or knitted fabric that is lightweight with a large volume, is soft and excellent in touch, is excellent in the heat-insulating properties and the anti-pilling properties, is excellent in sustainability of these properties, sheds no fluff, and is excellent in the water absorbency, a woven or knitted fabric using the textured spun yarn, and methods of manufacturing the textured spun yarn and the woven or knitted fabric. Moreover, another object of the present invention is to provide a textured spun yarn that can be applied to various spun yarns including spun yarns made of natural fibers, spun yarns made of synthetic fibers, and spun yarns made of semi-synthetic fibers, can be applied to small-lot varieties, and provide a woven or knitted fabric that has preferable texture corresponding to respective spun yarns, is lightweight with a large volume, is soft and excellent in touch, is excellent in the heat-insulating properties and the anti-pilling properties, is excellent in sustainability of these properties, sheds no fluff, and is excellent in the water absorbency using spun yarns with any count (thickness) from fine count yarns to low count yarns, a woven or knitted fabric using the textured spun yarn, and methods of manufacturing the textured spun yarn and the woven or knitted fabric.

In the inventions disclosed in Patent Documents 2 and 3 developed by the inventors before, a composite twisted yarn is created by twisting a spun yarn and a water-soluble yarn together in the opposite direction to the twisting direction of the spun yarn and a woven or knitted fabric is manufactured using the composite twisted yarn, and then, the water-soluble yarn in the woven or knitted fabric is dissolved and removed in water so as to obtain an airy stretch woven or knitted fabric. The inventors starch the spun yarn in a single yarn form without using the water-soluble yarn, dries it, and then, twists it in the opposite direction to the twisting direction of the single spun yarn by the predetermined number of twists. As a result, the inventors have found that the textured spun yarn obtained thereby contains no water-soluble yarn, can be knitted preferably although it is twisted reversely, and can provide a woven or knitted fabric which is lightweight with a large volume, is soft and excellent in touch, is excellent in the heat-insulating properties and the anti-pilling properties, is excellent in sustainability of these properties, sheds no fluff, and is excellent in the water absorbency by removing a starch agent in the textured spun yarn from a woven or knitted fabric obtained by performing weaving or knitting.

Further, the inventors have found the following. That is, when the starch agent in the textured spun yarn obtained by starching the spun yarn in the single yarn form, drying it, and twisting it in the opposite direction to the twisting direction of the single spun yarn by the predetermined number of twists is removed in water before the textured spun yarn is woven or knitted, the textured spun yarn after removing the starch agent can be also preferably knitted although the starch agent no longer adheres thereto and a woven or knitted fabric obtained by knitting and weaving the textured spun yarn is lightweight with a large volume, is soft and excellent in touch, is excellent in the heat-insulating properties and the anti-pilling properties, is excellent in sustainability of these properties, sheds no fluff, and is excellent in the water absorbency.

In addition, the inventors have found that the textured spun yarn obtained by twisting the starched and dried single spun yarn in the opposite direction to the twisting direction of the single spun yarn is more excellent in heat setting properties than the composite twisted yarn obtained by twisting the spun yarn and the water-soluble yarn in the opposite direction to the twisting direction of the spun yarn, weaving or knitting properties after heat setting are further improved, and removal of the starch agent and bulking with it are performed smoothly when the heat setting is performed. The inventors also have found that the textured spun yarn derived this time can be used when a woven or knitted fabric is manufactured using the yarn dyed in advance and when a manufactured woven or knitted fabric is dyed, and the woven or knitted fabric having the above-mentioned excellent characteristics is obtained in any of these two cases.

Further, the inventors have found that the technique developed by the inventors this time requires usage of the single spun yarn for manufacturing the textured spun yarn and the textured spun yarn providing the woven or knitted fabric excellent in lightweight properties, the volume, the softness, the preferable touch, the water absorbency, the rapid-drying properties, and the like cannot be obtained with usage of yarns formed by twisting equal to or more than two spun yarns together, such as two ply yarns, three ply yarns, and four ply yarns. Moreover, the inventors have found that the technique can use, as the single spun yarn for manufacturing the textured spun yarn, not only a single spun yarn made of cotton fibers but also various single spun yarns including single spun yarns made of natural fibers such as linen fibers and wool fibers, single spun yarns made of synthetic fibers, and single spun yarns made of semi-synthetic fibers, and can use, as the single spun yarn, single spun yarns with any count (thickness) from fine count yarns to a low count yarns. The inventors have completed the invention based on these various findings.

That is to say, the invention provides:

(1) a textured spun yarn obtained by twisting a starched and dried single spun yarn in an opposite direction to a twisting direction of a single spun yarn by the number of twists which is 1.3 to 3 times the number of twists of the single spun yarn;

(2) the textured spun yarn according to the aspect (1), wherein an adhesion amount of a starch agent in the starched and dried single spun yarn is 1 to 20 mass % relative to a mass of the single spun yarn before starched;

(3) the textured spun yarn according to the aspect (1) or (2), wherein starch is aqueous starch liquid obtained by dissolving a starch agent containing at least a water-soluble polymer of one type, which is selected from water-soluble synthetic polymers, water-soluble starches, water-soluble polysaccharides other than starches, and water-soluble proteins; and (4) the textured spun yarn according to any one of the aspects (1) to (3), which is heat-set after twisted in the opposite direction.

Further, the invention provides (5) a textured spun yarn obtained by removing the starch agent from the textured spun yarn according to any one of the aspects (1) to (4).

Moreover, the invention provides:

(6) a woven or knitted fabric (that is, woven or knitted fabric before removing the starch agent) that is manufactured by using at least the textured spun yarn according to any one of the aspects (1) to (4);

(7) a woven or knitted fabric obtained by removing the starch agent from the textured spun yarn and forming the woven or knitted fabric according to the aspect (6) from the woven or knitted fabric; and (8) a woven or knitted fabric (woven or knitted fabric to which the starch agent does not adhere) that is manufactured by using at least the textured spun yarn according to the aspect (5).

In addition, the invention provides:

(9) a textured spun yarn manufacturing method including at least starching a single spun yarn in a single yarn form with starch liquid prepared by dissolving a starch agent containing a water-soluble polymer in water, drying a starched single spun yarn, and twisting a starched and dried single spun yarn in an opposite direction to a twisting direction of the single spun yarn by the number of twists which is 1.3 to 3 times the number of twists of the single spun yarn; and

(10) a bulky textured spun yarn manufacturing method including at least starching a single spun yarn in a single yarn form with starch liquid prepared by dissolving a starch agent containing a water-soluble polymer in water, drying a starched single spun yarn, twisting a starched and dried single spun yarn in an opposite direction to a twisting direction of the single spun yarn by the number of twists which is 1.3 to 3 times the number of twists of the single spun yarn so as to manufacture a textured spun yarn, and dissolving and removing the starch agent from the textured spun yarn in water.

In addition, the invention provides:

(11) a woven or knitted fabric manufacturing method including performing weaving or knitting at least using the textured spun yarn according to any one of the aspects (1) to (4) so as to manufacture a woven or knitted fabric;

(12) a woven or knitted fabric manufacturing method including performing weaving or knitting at least using the textured spun yarn according to any one of the aspects (1) to (4) so as to manufacture a woven or knitted fabric, and then, dissolving and removing a starch agent from the textured spun yarn which forms the woven or knitted fabric; and

(13) a woven or knitted fabric manufacturing method including performing weaving or knitting at least using the textured spun yarn according to the aspect (5) so as to manufacture a woven or knitted fabric.

Hereinafter, the textured spun yarn according to the invention before the starch agent is removed is referred to as a "textured spun yarn ($A_0$)", and the textured spun yarn after the starch agent is removed from the textured spun yarn ($A_0$) is referred to as a "textured spun yarn ($A_1$)". Further, the woven or knitted fabric (woven or knitted fabric to which the starch agent still adheres) manufactured using the textured spun yarn ($A_0$) is referred to as a "woven or knitted fabric ($B_0$)", the woven or knitted fabric (woven or knitted fabric in which the starch agent has been removed) manufactured using the textured spun yarn ($A_1$) is referred to as a "woven or knitted fabric ($B_1$)", and the woven or knitted fabric obtained by treating the woven or knitted fabric ($B_0$) with water to dissolve and remove the starch agent from the textured spun yarn ($A_0$) which forms the woven or knitted fabric ($B_0$) is referred to as a "woven or knitted fabric ($B_2$)".

Both of the woven or knitted fabric ($B_2$) after the starch agent adhering to the textured spun yarn ($A_0$) is removed from the woven or knitted fabric ($B_0$) obtained by performing weaving or knitting using the textured spun yarn ($A_0$) according to the invention and the woven or knitted fabric ($B_1$) obtained by performing weaving or knitting using the textured spun yarn ($A_1$) according to the invention after the starch agent is removed swell largely, are soft and excellent in texture, are excellent in air permeability, heat-insulating properties, and water absorbency, and shed no fluff in comparison with a woven or knitted fabric formed by the single spun yarn itself used for manufacturing the textured spun yarn ($A_0$) for the following reason. That is, an action of returning twists to be in original states is largely made and bulking of the yarn occurs when the textured spun yarn ($A_0$) before forming a woven or knitted fabric is treated with water to dissolve and remove the starch agent or when the woven or knitted fabric ($B_0$) is treated with water to dissolve and remove the starch agent. In the invention, the woven or knitted fabric ($B_2$) after the starch agent is removed from the woven or knitted fabric ($B_0$) obtained by performing weaving or knitting using the textured spun yarn ($A_0$) and the woven or knitted fabric ($B_1$) obtained by performing weaving or knitting using the textured spun yarn ($A_1$) obtained by removing the starch agent from the textured spun yarn ($A_0$) exhibit a bulking action of the spun yarn with reverse twisting more significantly because when the single spun yarn to which the starch agent adheres is twisted in the opposite direction to the twisting direction of the single spun yarn so as to form the textured spun yarn ($A_0$), the single spun yarn is twisted directly in the opposite direction with absence of the water-soluble yarn. Therefore, they are further airy and excellent in the texture, the heat-insulating properties, and the like, in comparison with a woven or knitted fabric obtained by removing a water-soluble yarn from a woven or knitted fabric manufactured using the composite twisted yarn, which is obtained by twisting the spun yarn and the water-soluble yarn together in the opposite direction to the twisting direction of the spun yarn. The woven or knitted fabrics ($B_2$) and ($B_1$) obtained by using the textured spun yarns ($A_0$) and ($A_1$) according to the invention, respectively, are excellent in sustainability of the above-mentioned excellent characteristics and keep large volumes equivalent to those when the fabrics are new even after repeated washing, thereby keeping properties including the softness, the heat-insulating properties, the air permeability, the water absorbency, and the rapid-drying properties for a long period of time.

Both of the textured spun yarn ($A_0$) according to the invention to which the starch agent still adheres and the textured spun yarn ($A_1$) according to the invention after the starch agent is removed are excellent in weaving or knitting properties and enable target woven or knitted fabrics to be manufactured smoothly. The textured spun yarn ($A_0$) according to the invention contains no water-soluble yarn and is formed by the starched spun yarn alone. Therefore, when heat setting is performed on it, retention of twists with the heat setting is made reliably, so that the weaving or knitting properties are further improved. Both of the textured spun yarns ($A_0$) and ($A_1$) according to the invention can be used for both of a previous dyeing technique of manufacturing a woven or knitted fabric using a yarn dyed in advance (dyed yarn) and a piece dyeing technique of dyeing a woven or knitted fabric after the woven or knitted fabric is manufactured. Therefore, various woven or knitted fabrics can be manufactured smoothly using the textured spun yarns ($A_0$) and ($A_1$) according to the invention. In particular, in the invention, when removal of the starch agent from the textured spun yarn ($A_0$) and dyeing are performed in form of the yarn, the dyed textured spun yarn ($A_1$) (dyed yarn) can be obtained directly.

As a method of setting twists of the spun yarn, a method with heat setting, mercerization with an alkaline agent, ammonia treatment, and the like have been known conventionally. The method with the heat setting can be, however, applied to only a spun yarn made of a thermoplastic polymer and cannot be applied to a cotton spun yarn, a linen spun yarn, and the like. Further, a method of twisting and setting the spun yarn made of cotton or linen by the mercerization with the alkaline agent, the liquid ammonia treatment, or the like tends to generate denaturation, deterioration, and the like of the spun yarn due to a chemical agent such as the alkaline agent and the ammonia. In contrast, the invention provides the textured spun yarn ($A_0$) by twisting the starched and dried single spun yarn in the opposite direction to the twisting direction thereof. Therefore, as the single spun yarn, various single spun yarns including single spun yarns made of natural fibers such as cotton fibers, linen fibers, and wool fibers, single spun yarns made of synthetic fibers, and single spun yarns made of semi-synthetic fibers can be used. In addition, the chemical agent such as the alkaline agent and the ammonia is not used in the invention, so that denaturation, deterioration, and the like of the spun yarn are not generated. Further, in the invention, single spun yarns with any count (thickness) from fine count yarns to low count yarns can be used as the single spun yarn for obtaining the textured spun yarn ($A_0$). With this, the invention can provide the textured spun yarns ($A_0$) and ($A_1$) made of various materials and the textured spun yarns ($A_0$) and ($A_1$) having various thicknesses. Further, the various woven or knitted fabrics ($B_1$) and ($B_2$) that are lightweight with large volumes, are soft and excellent in touch, are excellent in the heat-insulating properties and the anti-pilling properties, are excellent in sustainability of these properties and anti-pilling properties, and shed no fluff can be manufactured by performing weaving or knitting using these textured spun yarns.

The invention can manufacture the textured spun yarns ($A_0$) and ($A_1$) providing high-quality woven or knitted fabrics that swell largely, are soft and excellent in texture, are excellent in the air permeability, the heat-insulating properties, and the water absorbency, and shed no fluff using an inexpensive starch agent without using a water-soluble yarn at lower cost than those in the conventional techniques.

DESCRIPTION OF THE EMBODIMENTS

Figure 1:
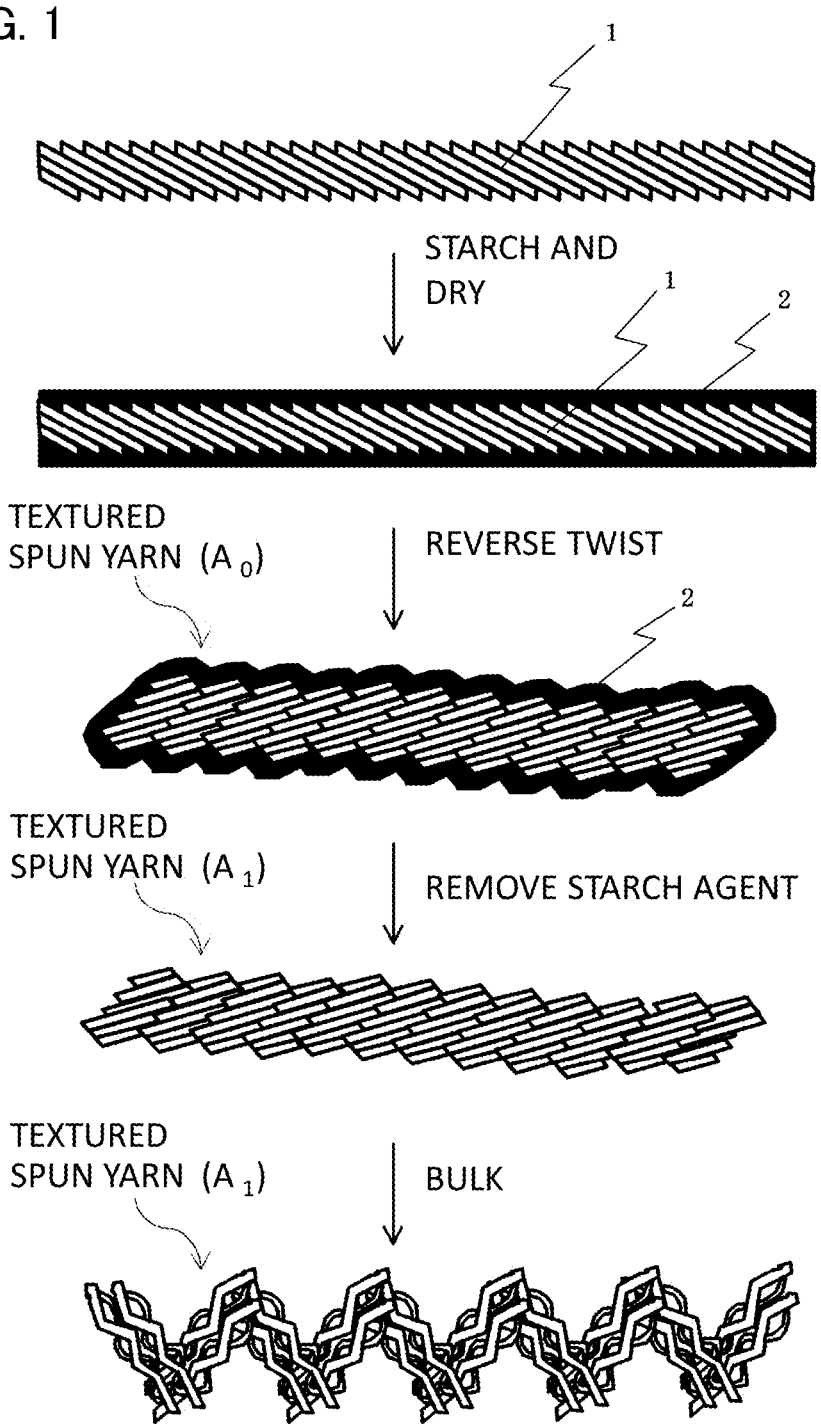
FIG. 1 is a view schematically illustrating a textured spun yarn ($A_0$) according to the present invention and a state when a starch agent is removed from the textured spun yarn ($A_0$).

Hereinafter, the invention will be described in detail. A textured spun yarn ($A_0$) in the invention is a textured spun yarn obtained by twisting a starched and dried single spun yarn in the opposite direction to the twisting direction of the single spun yarn by the number of twists which is 1.3 to 3 times the number of twists of the single spun yarn. Although not limiting at all, FIG. 1 schematically illustrates the textured spun yarn ($A_0$) according to the present invention and a state of the textured spun yarn when a starch agent is dissolved and removed in water from the textured spun yarn ($A_0$). In FIG. 1, a reference numeral 1 indicates a single spun yarn and a reference numeral 2 indicates a starch agent. As illustrated in FIG. 1, the single spun yarn 1 is prepared and is starched and dried so as to fix twists (original twists) of the single spun yarn 1. In this state, the single spun yarn 1 is reversely twisted in the opposite direction to the twisting direction of the single spun yarn 1 by the number of twists which is 1.3 to 3 times the number of twists (the number of twists of the original twists) of the single spun yarn. With this, the textured spun yarn ($A_0$) according to the invention is obtained. In a yarn form before the textured spun yarn ($A_0$) is used to form a woven or knitted fabric or after the woven or knitted fabric is manufactured using the textured spun yarn ($A_0$), the starch agent 2 adhering to the textured spun yarn ($A_0$) is dissolved and removed in water. With this, an action of returning to the original twists is made on the single spun yarn after the starch agent is removed, so that the textured spun yarn ($A_1$) or the woven or knitted fabric ($B_2$) is made into a bulked state. As a result, both of the woven or knitted fabric ($B_1$) obtained by performing weaving or knitting using the textured spun yarn ($A_1$) and the woven or knitted fabric ($B_2$) obtained by removing the starch agent from the woven or knitted fabric ($B_0$) obtained by performing knitting and weaving using the textured spun yarn ($A_0$) swell largely, are soft and excellent in texture, are excellent in air permeability, heat-insulating properties, and water absorbency.

The textured spun yarn ($A_0$) according to the invention needs to be formed using a "single yarn" spun using fibers as it is, that is, a "single spun yarn". If the spun yarn forming the textured spun yarn ($A_0$) is spun yarns manufactured by twisting equal to or more than two spun yarns together, such as two ply yarns, three ply yarns, and four ply yarns, even when the spun yarns are starched, and then, dried so as to form a textured spun yarn by twisting them in the opposite direction to the twisting direction of the spun yarns and the starch agent in the textured spun yarn is dissolved and removed in water in the yarn form or after forming the woven or knitted fabric, they swell a little, are deteriorated in the lightweight properties, the heat-insulating properties, the water absorbency, and the like, and are poor in soft texture. Due to this, the spun yarns cannot achieve the object of the invention.

As the single spun yarn forming the textured spun yarn ($A_0$) according to the invention, any single spun yarn is employed as long as it is spun using fibers that are not dissolved in water (hot water, warm water, cold water) as it is. Examples thereof include single spun yarns made of fibers of one type selected from natural fibers such as cotton, linen, silk, and wool, synthetic fibers such as polyester fibers, polyamide fibers, polypropylene fibers, acrylic fibers, water (hot water)-insoluble polyvinyl alcohol-series fibers and polyvinylidene chloride fibers, semi-synthetic fibers such as acetate, and regenerated fibers such as rayon and cupra, and blended spun yarns made of equal to or more than two types selected from the above-mentioned fibers. It is sufficient that an appropriate single spun yarn is selected in accordance with a type and an application of a woven or knitted fabric to be manufactured using the textured spun yarn ($A_0$) according to the invention.

The twisting direction of the single spun yarn may be S twists or Z twists. Further, the number of twists of the single spun yarn is not particularly limited. In general, when the number of twists of the single spun yarn is assumed to be T (unit: twist times/2.54 cm) and cotton count is assumed to be S (unit: count), a single spun yarn having a twist coefficient K expressed by $K=T/\sqrt{S}$ of 2 to 6 is preferable in points of availability of the single spun yarn, quality stability, productivity and manufacturing stability when the textured spun yarn according to the invention is manufactured, bulkiness after the starch agent is dissolved and removed from the textured spun yarn or the woven or knitted fabric manufactured using the textured spun yarn, and the like. For example, when the single spun yarn having yarn count of 20 is employed, the number of twists of the single spun yarn is preferably 10 to 25 twist times/2.54 cm, and more preferably, 15 to 20 twist times/2.54 cm.

The thickness of the single spun yarn is not particularly limited. For example, the single spun yarn having the thickness of yarn count of 5 to 120 (about 50 dtex to 1180 dtex), preferably, 6 to 80 (about 74 dtex to 980 dtex), and more preferably, 10 to 60 (about 98 dtex to 590 dtex) is preferably used in terms of yarn count (tex) in points of availability and usability for various woven or knitted fabrics.

Any starch agent conventionally used for starching yarns and woven or knitted fabrics can be used as the starch agent that is used for starching the single spun yarn in order to obtain the textured spun yarn ($A_0$). Examples thereof include water-soluble synthetic polymers, water-soluble starches, water-soluble polysaccharides other than starches and water-soluble proteins, and a starch agent containing one or equal to or more than two types of them can be used. To be specific, one or equal to or more than two types of water-soluble polymers including synthetic polymers such as water-soluble polyvinyl alcohol and water-soluble acrylic polymer, water-soluble starches and processed starches, water-soluble polysaccharides such as carboxymethyl cellulose and sodium alginate, and water-soluble proteins such as water-soluble collagen partial hydrolysates can be used as the starch agent. Among them, as the starch agent, the water-soluble polyvinyl alcohol or a combination of the water-soluble polyvinyl alcohol and the starch is used preferably, and the water-soluble polyvinyl alcohol is used alone more preferably. Starch liquid obtained by dissolving the starch agent containing polyvinyl alcohol as a main component in water is reduced in increase of viscosity over time and is excellent in quality stability, so that it can be used continuously for a long period of time. Further, the above starch liquid can be used commonly to various fibers (various single spun yarns) and is highly adaptable. With the above starch liquid, when the textured spun yarn ($A_0$) is manufactured by twisting the single spun yarn after starched and dried in the opposite direction to the twisting direction of the single spun yarn, the textured spun yarn ($A_0$) can be manufactured smoothly without generating yarn breakage of the single spun yarn. In addition, the above starch agent can be removed in water easily and smoothly from the textured spun yarn ($A_0$) or the woven or knitted fabric ($B_0$) manufactured using the same.

When the starched and dried single spun yarn is twisted in the opposite direction to the twisting direction of the single spun yarn so as to form the textured spun yarn ($A_0$) according to the invention (hereinafter, twisting of the single spun yarn in the opposite direction to the twisting direction of the single spun yarn is referred to as "reverse twist" simply in some cases), an adhesion amount (dry mass) of the starch agent in the single spun yarn at the time of the reverse twist may be different depending on the type of the starch agent, the type of fibers forming the single spun yarn, the thickness of the single spun yarn, the number of twists of the single spun yarn, the number of reverse twists, and the like. In general, the adhesion amount is 1 to 20 mass % preferably, 2 to 15 mass % more preferably, and 3 to 10 mass % still more preferably. When the adhesion amount (dry mass) of the starch agent in the single spun yarn is set to be in the above-mentioned range, the single spun yarn to which the starch agent is made to adhere can be twisted reversely without generating yarn breakage and removal of the starch agent from the textured spun yarn ($A_0$) obtained by reversely twisting the single spun yarn or removal of the starch agent from the woven or knitted fabric ($B_0$) obtained by performing weaving or knitting using the textured spun yarn ($A_0$) can be performed smoothly. In contrast, when the adhesion amount of the starch agent in the single spun yarn is too small, the yarn breakage is generated frequently when the single spun yarn is twisted reversely and it becomes difficult to manufacture the textured spun yarn ($A_0$) continuously. On the other hand, when the adhesion amount of the starch agent in the single spun yarn is too large, the cost is increased, the degree of extensibility of the single spun yarn is not observed and productivity is lowered, it takes much time to remove the starch agent from the textured spun yarn ($A_0$) or the woven or knitted fabric ($B_0$) and productivity is lowered, and the starch agent cannot be removed completely depending on cases and bulking of the yarn is insufficient. This results in a problem that the textured spun yarn ($A_1$), the woven or knitted fabric ($B_1$), and the woven or knitted fabric ($B_2$) excellent in characteristics including the texture cannot be easily obtained.

The twisting direction of the textured spun yarn ($A_0$) according to the invention is opposite to the twisting direction of the single spun yarn and the number of twists Ay (unit: twist times/m) of the textured spun yarn ($A_0$) needs to be in a range of 1.3 to 3 times (that is, Ay/By=1.3 to 3) the number of twists By (unit: twist times/m) of the single spun yarn. In the textured spun yarn ($A_0$) according to the invention, the number of twists (Ay) of the textured spun yarn ($A_0$) is made larger than the number of twists (By) of the single spun yarn and a ratio (Ay/By) between both the numbers of twists is set to be in the above-mentioned specific range of 1.3 to 3. With this, when the single spun yarn is reversely twisted for manufacturing the textured spun yarn ($A_0$), the reverse twists are made in the direction of untwisting the twists of the single spun yarn while keeping form stability (twist stability) of the single spun yarn with the starch and the single spun yarn is further twisted in the opposite direction to the twisting direction of the single spun yarn from a zero state in a state where the starch agent adheres thereto. This prevents a problem that short fibers forming the single spun yarn are separated and the yarn breaks at the time of the reverse twist from occurring and the untwisting of the single spun yarn and the reverse twist subsequent thereto are performed preferably. Then, the starch agent adhering to the textured spun yarn ($A_0$) is dissolved and removed in water or the starch agent is dissolved and removed in water from the woven or knitted fabric ($B_0$) manufactured using the textured spun yarn ($A_0$). With this, repulsion is generated among original fibers forming the single spun yarn twisted in the direction opposite to the direction of the textured spun yarn in the textured spun yarn in a state where torque acts in the original twisting direction of the single spun yarn. This provides the textured spun yarn ($A_1$), the woven or knitted fabric ($B_1$), and the woven or knitted fabric ($B_2$) according to the invention, which swell, are excellent in texture, the lightweight properties, the heat-insulating properties, the water absorbency, and the like, and are excellent in sustainability of these properties.

When the number of twists (Ay) of the reverse twists of the textured spun yarn ($A_0$) is lower than 1.3 times the number of twists (By) of the single spun yarn, the untwisting of the single spun yarn is insufficient at the time of the reverse twist for manufacturing the textured spun yarn ($A_0$). Due to this, when the starch agent is dissolved and removed in water, the swelling, the lightweight, the heat-insulating properties, the softness, and the like cannot be achieved sufficiently. In addition, in such a case, lowering of the strength and lowering of the anti-pilling properties are generated, resulting in failing to obtain the textured spun yarn ($A_1$) or the woven or knitted fabric that is excellent in the texture, the light weight properties, the softness, the heat-insulating properties, the water absorbency, the strength, the anti-pilling properties, and the like. On the other hand, when the number of twists (Ay) of the reverse twists of the textured spun yarn ($A_0$) is higher than 3 times the number of twists (By) of the single spun yarn, troubles such as yarn breakage occur in the twisting process when the single spun yarn is reversely twisted (in the twisting process for manufacturing the textured spun yarn ($A_0$)). This lowers productivity of the textured spun yarn ($A_0$) and is not preferable. In the textured spun yarn ($A_0$) according to the invention, the number of twists (Ay) of the reverse twists is 1.4 to 3 times the number of twists (By) of the single spun yarn (Ay/By=1.4 to 3) preferably, and is 1.5 to 2 times the number of twists (By) (Ay/By=1.5 to 2) more preferably. Meanwhile, the "number of twists of the textured spun yarn ($A_0$)" referred in the specification indicates the number of twists when the starched and dried single spun yarn is twisted in the opposite direction to the twisting direction of the single spun yarn, and is a value in accordance with the set number of twists in the twisting process actually.

The textured spun yarn ($A_0$) may be in the state of being reversely twisted as it is or may be heat-set after the reverse twist if necessary. When the textured spun yarn ($A_0$) is heat-set, torque and a frizzy state with the reverse twist are temporarily fixed. This improves weaving or knitting properties when the woven or knitted fabric is manufactured using the textured spun yarn ($A_0$).

The textured spun yarn ($A_0$) according to the invention can be manufactured as follows. That is, the single spun yarn is moved in a single yarn form while being dipped in the starch liquid obtained by dissolving the starch agent in water so as to make the starch liquid adhere to the entire single spun yarn. Thereafter, the single spun yarn is taken out of the starch liquid and dried in the single yarn form such that the single spun yarns do not adhere to one another so as to manufacture a single spun yarn (dried single spun yarn) to which the starch agent adheres. Then, the textured spun yarn ($A_0$) can be manufactured by twisting the single spun yarn (dried single spun yarn) obtained thereby to which the starch agent adheres in the opposite direction to the twisting direction of the single spun yarn by the number of twists which is 1.3 to 3 times the number of twists of the single spun yarn. In addition, the heat setting process may be performed after the reverse twist if necessary.

In order to obtain the textured spun yarn ($A_0$), the concentration of the starch liquid when the single spun yarn is starched may be different depending on the type of the starch agent, the type of fibers forming the single spun yarn, the thickness of the single spun yarn, the number of twists of the single spun yarn, the amount of the starch agent adhering to the single spun yarn, the movement speed of the single spun yarn in the starch liquid at the time of the starching, the temperature of the starch liquid at the time of the starching, the number of twists when the starched and dried single spun yarn is reversely twisted. When the above-mentioned water-soluble polymer (in particular, water-soluble polyvinyl alcohol) is used as the starch agent, in general, the concentration of the starch liquid is 1 to 15 mass % preferably, 1.5 to 12 mass % more preferably, and 2 to 10 mass % still more preferably. When the concentration of the starch liquid at the time of the starching to the single spun yarn is too low, it becomes difficult to make the starch agent of a predetermined amount adhere to the single spun yarn and the yarn breakage is easy to occur when the starched and dried single spun yarn is reversely twisted. On the other hand, when the concentration of the starch liquid is too high, it becomes difficult to make the starch agent adhere to the single spun yarn uniformly and perform removal of the starch agent from the textured spun yarn ($A_0$) obtained by reversely twisting the single spun yarn or removal of the starch agent from the woven or knitted fabric ($B_0$) obtained by performing weaving or knitting using the textured spun yarn ($A_0$) smoothly because the excess starch agent adheres to the single spun yarn.

The temperature of the starch liquid when the single spun yarn is dipped in the starch liquid is 20 to 80° C. preferably, 30 to 70° C. more preferably, 40 to 60° C. still more preferably, in order to make the starch liquid adhere to the entire single spun yarn uniformly and cause the single spun yarn to be impregnated with the starch liquid. When the temperature of the starch liquid is too low, it becomes difficult to make the starch liquid adhere to the single spun yarn uniformly. On the other hand, when the temperature of the starch liquid is too high, denaturation of the starch agent, increase in the energy cost, and the like tend to occur.

The dry temperature of the single spun yarn to which the starch liquid adheres may be different depending on the type of the starch agent (starch liquid), the type of the single spun yarn, and the like. In general, the single spun yarn is dried at a temperature of 60 to 100° C. preferably, and 70 to 90° C. more preferably. Any dry methods and drying devices may be employed as long as they enable the single spun yarn to be dried in the single yarn form such that the single spun yarns do not adhere to one another at the time of drying. Although not limiting at all, for example, the following method can be employed. That is, the single spun yarn to which the starch liquid adheres is moved while being wound around the surface of a rotating dry drum from one end portion in a spiral form in the single yarn state and it is dried with the dry drum. The dried single spun yarn to which the starch agent adheres may be moved to the subsequent reverse twisting process as it is so as to be reversely twisted. Alternatively, it may be rolled up once, and then, processed in the subsequent reverse twist process.

The type of a twisting machine when the starched and dried single spun yarn is reversely twisted is not particularly limited. For example, twisting machines such as a double twister, a ring twister, and an up twister can be used. The textured spun yarn ($A_0$) according to the invention obtained in the above-mentioned manner has torque, in general. Even if the textured spun yarn ($A_0$) has the torque, in the case where no failure is generated when the starch agent is dissolved and removed in water from the textured spun yarn ($A_0$) to manufacture the textured spun yarn ($A_1$) or when the woven or knitted fabric ($B_0$) is manufactured using the textured spun yarn ($A_0$), the textured spun yarn ($A_0$) can be used for the process of dissolving and removing the starch agent in water from the textured spun yarn ($A_0$) to manufacture the textured spun yarn ($A_1$) as it is without reducing the torque and can be also used for manufacturing the woven or knitted fabric ($B_0$) as it is. In the case where a failure is generated when the starch agent is dissolved and removed with water from the textured spun yarn ($A_0$) to manufacture the textured spun yarn ($A_1$) or when the woven or knitted fabric ($B_0$) is manufactured using the textured spun yarn ($A_0$) because the textured spun yarn ($A_0$) has the torque, it is preferable that heat processing (heat setting) be performed to reduce the torque. The heat processing temperature in this case needs to be determined based on the type of the single spun yarn forming the textured spun yarn ($A_0$), the type of the starch agent, the strength of the torque, and the like. Although not limiting, when the single spun yarn is a cotton yarn and the starch agent is made of polyvinyl alcohol, it is preferable that the heat processing (heat setting processing) is performed at a temperature of 50 to 110° C. preferably, and 70 to 95° C. more preferably, in general. A method such as steam setting and hot-air setting can be employed for the heat processing (heat setting). The textured spun yarn ($A_0$) obtained by the above-mentioned method is preferably made into a skein form or a wound yarn form that the textured spun yarn ($A_0$) is wound around a pipe.

In the invention, the starch agent adhering to the textured spun yarn ($A_0$) in the yarn form before the textured spun yarn ($A_0$) is used to form the woven or knitted fabric may be dissolved and removed in water so as to manufacture the textured spun yarn ($A_1$), and then, the woven or knitted fabric ($B_1$) may be manufactured using the textured spun yarn ($A_1$). Alternatively, the starch agent may be dissolved and removed with water after the woven or knitted fabric ($B_0$) is manufactured using the textured spun yarn ($A_0$). In any of these cases, the woven or knitted fabric that swells largely, is soft and excellent in texture, is excellent in air permeability, heat-insulating properties, and water absorbency, and sheds no fluff in comparison with the woven or knitted fabric manufactured using the single spun yarn itself used for manufacturing the textured spun yarn ($A_0$) as it is can be obtained.

The temperature of water when the starch agent adhering to the textured spun yarn ($A_0$) is dissolved and removed in water from the textured spun yarn ($A_0$) before the woven or knitted fabric is manufactured so as to form the textured spun yarn ($A_1$) and the temperature of water when the starch agent is dissolved and removed in water from the woven or knitted fabric ($B_0$) manufactured using the textured spun yarn ($A_0$) so as to form the woven or knitted fabric ($B_2$) may be different depending on the type of the starch agent. In general, the temperature of water is 20 to 100° C. preferably, 40 to 90° C. more preferably, and 50 to 80° C. still more preferably. In the textured spun yarn ($A_0$) and the woven or knitted fabric ($B_0$), the starch agent in a thin film form adheres to the textured spun yarn ($A_0$). Therefore, the starch agent can be removed easily and rapidly in comparison with the case where a water-soluble yarn is dissolved and removed in water from a composite twisted yarn obtained by twisting the spun yarn and the water-soluble yarn together in the opposite direction to the twisting direction of the spun yarn or a woven or knitted fabric manufactured using the composite twisted yarn.

When the starch agent is dissolved and removed with water from the textured spun yarn ($A_0$) before forming the woven or knitted fabric, the starch agent may be dissolved and removed in water while taking the textured spun yarn ($A_0$) on a reel, the starch agent may be dissolved and removed in water in a state where the textured spun yarn ($A_0$) is wound into a cheese shape around a bobbin for dyeing, or the starch agent may be dissolved and removed in water in a state where the textured spun yarn ($A_0$) is wound around a beam for dyeing. Alternatively, a method other than them may be employed. When the starch agent is dissolved and removed in water in the state where the textured spun yarn ($A_0$) is wound into the cheese shape, the starch agent can be dissolved and removed while enabling efficient small-lot production.

When the removal of the starch agent from the textured spun yarn ($A_0$) before forming the woven or knitted fabric and the removal of the starch agent from the woven or knitted fabric ($B_0$) manufactured using the textured spun yarn ($A_0$) are performed using a kettle of a dyeing machine, the starch agent can be dissolved and removed efficiently. When the kettle of the dyeing machine is used, the textured spun yarn ($A_1$) obtained by dissolving and removing the starch agent or the woven or knitted fabric ($B_2$) obtained by dissolving and removing the starch agent from the woven or knitted fabric ($B_0$) may be dyed subsequently using the same kettle after the starch agent is dissolved and removed.

After the starch agent is dissolved and removed in water from the textured spun yarn ($A_0$) before forming the woven or knitted fabric or after the starch agent is removed from the woven or knitted fabric ($B_0$), the yarn or the woven or knitted fabric is preferably washed with water in order to remove components of the starch agent adhering to the yarn or the woven or knitted fabric sufficiently. The textured spun yarn ($A_1$) obtained by removing the starch agent from the textured spun yarn ($A_0$) and the woven or knitted fabric ($B_2$) obtained by removing the starch agent from the woven or knitted fabric ($B_0$) manufactured using the textured spun yarn ($A_0$) may be subject to dyeing processing, processing of applying an oil solution for prompting lubrication, water repellent processing, processing of applying a functional processing agent for antibacterial processing or the like, and the like may be performed if necessary while preventing lowering of the swelling, the lightweight properties, the heat-insulating properties, the water absorbency, the texture, and the like. In addition, a yarn process such as twisting may be performed on the textured spun yarn ($A_1$). The textured spun yarn ($A_1$) obtained by removing the starch agent is made in the skein form or the wound yarn form that it is wound around the pipe so as to be used for manufacturing the woven or knitted fabric desirably.

The woven or knitted fabric ($B_0$) containing the textured spun yarn ($A_0$) to which the starch agent still adheres can be obtained by performing weaving or knitting using the textured spun yarn ($A_0$) as at least a part of yarns for manufacturing the woven or knitted fabric. Further, the woven or knitted fabric ($B_1$) can be obtained by performing weaving or knitting using the textured spun yarn ($A_1$) obtained by removing the starch agent as at least a part of yarns for manufacturing the woven or knitted fabric. A usage ratio of the textured spun yarn ($A_0$) in the woven or knitted fabric ($B_0$) and a usage ratio of the textured spun yarn ($A_1$) in the woven or knitted fabric ($B_1$) can be adjusted in accordance with the type of the woven or knitted fabric, an application, properties required for the woven or knitted fabric (texture, lightweight properties, heat-insulating properties, water absorbency, softness, swelling degree, and the like). In order to obtain the woven or knitted fabric that is lightweight with a large volume, is soft and excellent in touch, is excellent in the heat-insulating properties, the air permeability, and the water absorbency, in the woven or knitted fabric ($B_0$), the textured spun yarn ($A_0$) is preferably used such that a ratio of the textured spun yarn after removing the starch agent in the woven or knitted fabric ($B_2$) obtained by removing the starch agent from the woven or knitted fabric ($B_0$) is equal to or higher than 10 mass % preferably, and equal to or higher than 20 mass % more preferably relative to the mass of the woven or knitted fabric ($B_2$) after removing the starch agent. In addition, in the woven or knitted fabric ($B_1$), the ratio of the textured spun yarn ($A_1$) is equal to or higher than 10 mass % preferably, and equal to or higher than 20 mass % more preferably, relative to the mass of the woven or knitted fabric ($B_1$).

Both of the woven or knitted fabric ($B_2$) after the starch agent is removed from the woven or knitted fabric ($B_0$) obtained by performing weaving or knitting using the textured spun yarn ($A_0$) and the woven or knitted fabric ($B_1$) obtained by performing weaving or knitting using the textured spun yarn ($A_1$) swell largely, are soft and excellent in texture, are excellent in the air permeability, the heat-insulating properties, and the water absorbency, and shed no fluff, that is, have preferable characteristics. These woven or knitted fabrics may be subject to refinement processing and heat processing if necessary. Note that processing (for example, excess tension and calendar processing) causing lowering of the characteristics including the swelling, the texture, the light weight properties, the air permeability, the heat-insulating properties, and the water absorbency is preferably avoided.

The types of the woven or knitted fabric ($B_0$) manufactured using the textured spun yarn ($A_0$) [eventually, woven or knitted fabric ($B_2$)] and the woven or knitted fabric ($B_1$) manufactured using the textured spun yarn ($A_1$) are not particularly limited. Examples of the woven fabric include a plain weave (a plain textile), a twill weave (a twill textile), a sateen weave (a sateen textile), a Jacquard weave, a pile weave, a denim, and a gingham. Examples of the knit fabric include a flat knit fabric, a warp knit fabric, a circular knit fabric, and a pile knitted fabric. When the woven fabric is used, the woven fabric may be manufactured using the textured spun yarn ($A_0$) or the textured spun yarn ($A_1$) as a warp and a weft, the woven fabric may be manufactured using the textured spun yarn ($A_0$) or the textured spun yarn ($A_1$) as only one of the warp and the weft, or the woven fabric may be manufactured using the textured spun yarn ($A_0$) or the textured spun yarn ($A_1$) as a part of the warp and/or a part of the weft. As for the pile woven or knitted fabric such as the pile woven fabric and the pile knitted fabric, when the pile woven or knitted fabric is manufactured using the textured spun yarn ($A_0$) or the textured spun yarn ($A_1$) as a pile yarn, the pile woven or knitted fabric such as a towel cloth and a wiping cloth, which has preferable airy texture and is excellent in the lightweight properties, the air permeability, the water absorbency, and the heat-insulating properties, can be manufactured.

The woven or knitted fabric ($B_2$) according to the invention that is manufactured using the textured spun yarn ($A_0$) according to the invention and the woven or knitted fabric ($B_1$) that is manufactured using the textured spun yarn ($A_1$) according to the invention are lightweight with large volumes, are soft and excellent in touch, are excellent in the air permeability, the heat-insulating properties, and the water absorbency, are excellent in sustainability of these excellent properties, shed no fluff, and are excellent in the anti-pilling properties. Therefore, they can be effectively used for towels, sport clothes, underwear, foundations, jeans, outer clothes, other clothes, medical purposes such as elastic wraps, vehicle interior materials, belt conveyor fabrics, other industrial materials, and the like, for example, while utilizing these excellent characteristics.

EXAMPLES

Hereinafter, the invention is described in detail with Examples and the like. The invention is not limited by the following examples at all. In the following Examples and Comparison Examples, an adhesion amount (dry mass) of the starch agent in the starched and dried single spun yarn was calculated as follows.

<Calculation Method of Adhesion Amount of Starch Agent in Starched and Dried Single Spun Yarn>

(1) (i) The starched and dried single spun yarn to which the starch agent adheres is extracted by 1000 m and is dried at 100° C. so as to be made into an absolute dry state (state where mass decrease is not observed). Then, the mass (Wa) (g) at this time is measured.

(ii) The single spun yarn (1000 m) the mass of which has been measured in the above-mentioned process (i) and to which the starch agent adheres is processed in accordance with JIS L 1095:2010 "starch component C method (sodium carbonate method)" to remove the starch agent, and then, is dried at 100° C. so as to be made into the absolute dry state (state where mass decrease is not observed). Then, the mass (Wb) (g) at this time is measured to obtain an adhesion amount (mass %) of the starch agent from the following equation <1>.

$$\text{Adhesion amount of starch agent } (C)(\text{mass } \%) = [(Wa - Wb)/Wb] \times 100 \quad \langle 1 \rangle$$

(iii) The operations in the above-mentioned processes (i) and (ii) are repeated five times and an average value thereof (C mean) (mass %) is obtained.

(2) (i) The single spun yarn before the starch agent is made to adhere thereto is extracted by 1000 m and is absolute-dried at 100° C., and the mass ($W_1$) (g) thereof at this time is measured.

(ii) The single spun yarn (1000 m) the mass of which has been measured in the above-mentioned process (i) and to which the starch agent does not adhere is processed in accordance with JIS L 1095:2010 "starch component C method (sodium carbonate method)" in the same manner as the above-mentioned process (1) (ii), and then, is dried at 100° C. so as to be made into the absolute dry state (state where mass decrease is not observed). Then, the mass ($W_0$) (g) thereof at this time is measured to obtain mass decrease (D) (mass %) with treatment with the sodium carbonate from the following equation <2>.

$$\text{Mass decrease } (D)(\text{mass } \%) \text{ with } NaCO_3 \text{ treatment} = [(W_1 - W_0)/W_0] \times 100 \quad \langle 2 \rangle$$

(iii) The operations in the above-mentioned processes (i) and (ii) are repeated five times and an average value thereof (D mean) (mass %) is obtained.

(3) The adhesion amount (absolute dry state) (mass %) of the starch agent in the starched and dried single spun yarn is obtained from the following equation <3>.

$$\text{Adhesion amount of starch agent in single spun yarn (mass } \%) = C \text{ mean} - D \text{ mean} \quad \langle 3 \rangle$$

In the following Examples and Comparison Examples, reverse twist properties of a non-starched single spun yarn and a starched and dried single spun yarn when twisting them in the opposite direction to the twisting direction of the original single spun yarn to manufacture textured spun yarns were evaluated based on evaluation references as indicated in the following Table 1.

TABLE 1

Evaluation references of reverse twist properties of non-starched single spun yarn and starched single spun yarn (after dried)

| | EVALUATION CONTENTS |
|---|---|
| ◎ | Yarn breakage does not occur at the time of reverse twist for manufacturing a textured spun yarn and a reverse yarn-twisting process can be performed continuously with high productivity. |
| ○ | Yarn breakage occurs at the time of reverse twist for manufacturing a textured spun yarn in some cases but frequency of the yarn breakage is low and a reverse yarn-twisting process can be performed substantially continuously. |

TABLE 1-continued

| Evaluation references of reverse twist properties of non-starched single spun yarn and starched single spun yarn (after dried) | |
|---|---|
| | EVALUATION CONTENTS |
| Δ | Yarn breakage frequently occurs at the time of reverse twist for manufacturing a textured spun yarn and a reverse yarn-twisting process cannot be performed continuously. |
| X | Yarn breakage occurs while a single spun yarn is set to a twisting machine for manufacturing a textured spun yarn and a reverse yarn-twisting process cannot be performed. |

<Evaluation of Texture of Textured Spun Yarn>

Texture of a textured spun yarn obtained in the following Examples and Comparison Examples was evaluated as follows. Texture of the textured spun yarn [textured spun yarn ($A_1$) obtained by dissolving and removing the starch agent from the textured spun yarn ($A_0$) in water] was evaluated based on evaluation references as indicated in the following Table 2 with reference to texture of a single spun yarn (original single spun yarn) used for manufacturing the textured spun yarn.

TABLE 2

| Evaluation references of texture of textured spun yarn | |
|---|---|
| | EVALUATION CONTENTS |
| ◎ | It swells to be much larger, is much softer, and has much more preferable texture than an original single spun yarn. |
| ○ | It swells to be larger, is softer, and has more preferable texture than an original single spun yarn. |
| Δ | It swells to be a little larger, and is a little softer than an original single spun yarn. |
| X | It has the same appearance (contraction degree) and has the same touch as those of an original single spun yarn. |

<Evaluation of Texture of Woven or Knitted Fabric>

Texture of a woven or knitted fabric (interlock knitted fabric and pile knitted fabric) obtained in the following Examples and Comparison Examples was evaluated as follows. (1) Texture of Woven or Knitted Fabric: The texture of the woven or knitted fabric was evaluated based on evaluation references as indicated in the following Table 3 with reference to texture of a woven or knitted fabric (interlock knitted fabric and pile knitted fabric) obtained by performing weaving or knitting into same tissues using the same single spun yarn as that used for obtaining the textured spun yarn and using the same machine.

TABLE 3

| Evaluation references of texture of knit fabric | |
|---|---|
| | EVALUATION CONTENTS |
| ◎ | It swells to be much larger, is much softer, and has much more preferable texture than an interlock knitted fabric or a pile knitted fabric manufactured using an original single spun yarn. |
| ○ | It swells to be larger, is softer, and has more preferable texture than an interlock knitted fabric or a pile knitted fabric manufactured using an original single spun yarn. |
| Δ | It swells to be a little larger, and is a little softer than an interlock knitted fabric or a pile knitted fabric manufactured using an original single spun yarn. |
| X | It has the same appearance (swelling degree or contraction degree) and has the same touch as those of an interlock knitted fabric or a pile knitted fabric manufactured using an original single spun yarn. |

Examples 1 to 4 and Comparison Examples 1 to 5

(1) A 10 count single spun yarn ("TS10 single yarn" manufactured by KB Tsuzuki K.K.) made of 100% cotton fibers, which had the number of twists of 500 twist times/m (Z twists), was used as the single spun yarn. The number T of twists of the single spun yarn per 2.54 cm was 12.7 and the count S was 10. Based on them, a twist coefficient K from the equation of $K=(T/\sqrt{S})$ was $12.7/\sqrt{10}=12.7/3.16=4.02$.

(2) The single spun yarn prepared in the above-mentioned process (1) was moved while being continuously dipped in a starch liquid tank with starch liquid of a 6 mass % aqueous solution or a 1.5 mass % aqueous solution of water-soluble polyvinyl alcohol ("SW-1" manufactured by Mizobata Chemical, Inc.) (the temperature of the starch liquid was 50° C.), or in a water tank with water containing no water-soluble polyvinyl alcohol (the temperature was 50° C.) in the single yarn form. Thereafter, it was taken out of the starch liquid tank or the water tank and was moved and dried while being wound around the surface of the rotating dry drum of which the surface temperature was 80° C. in a spiral form. Subsequently, it was steam-set with steam at 95° C. and rolled up around the pipe. The adhesion amount of the starch agent in the single spun yarn calculated thereby (adhesion amount in the absolute dry state) was calculated by the above-mentioned method. The result thereof was as indicated in the following Table 4.

(3) The single spun yarn (dried single spun yarn) to which the starch agent adhered, which was obtained in the above-mentioned process (2), or a non-starched single spun yarn was supplied to a double twister ("36M" manufactured by Murata Machinery, Ltd.) and twisted in the opposite direction to the twisting direction of the single spun yarn by the number of twists as indicated in the following Table 4 so as to manufacture a textured spun yarn. Then, the textured spun yarn was steam-set with steam at the temperature of 95° C. and rolled up around a pipe. The reverse twist properties in this case were evaluated based on the evaluation references as indicated in the above Table 1. The result thereof was as indicated in the following Table 4.

(4) In the textured spun yarn obtained in the above-mentioned process (3), a part of the textured spun yarn obtained by twisting the single spun yarn, to which the starch liquid was applied and which was dried, in the opposite direction to the twisting direction of the single spun yarn was rewound from the pipe in the skein form. Then, the textured spun yarn was dipped in hot water (temperature 90° C.) and the starch agent adhering thereto was dissolved and removed. After that, it was dried at 50° C. to create a textured spun yarn in which the starch agent was removed. Texture of the obtained textured spun yarn was evaluated based on the evaluation references as indicated in the above Table 2. The result thereof was as indicated in the following Table 4.

(5) An interlock fabric was knitted by a 14G circular knitting machine using the textured spun yarn in which the starch agent was removed, which was obtained in the above-mentioned process (4). Then, the obtained interlock knitted fabric was refined in a bath by a continuous refining machine at 95° C. and was dried by a hot-air dryer at 150° C. Texture of the interlock knitted fabric obtained thereby was evaluated based on the evaluation references as indicated in the above Table 3 with reference to an interlock knitted fabric obtained by knitting an interlock fabric by the 14G circular knitting machine using the original single spun yarn as it was, refining the obtained interlock knitted fabric in a bath by the continuous refining machine at 95° C., and drying it by the hot-air dryer at 150° C. The result thereof was as indicated in the following Table 4.

(6) A pile knitted fabric was manufactured by a 20G sinker piling machine (sinker length: 1.7 mm) using the textured spun yarn to which the starch agent adhered, which was obtained in the above-mentioned process (3), as a pile yarn and using a 20 count single spun yarn ("TS20 single yarn" manufactured by KB Tsuzuki K.K.) made of 100% cotton fibers, which had the number of twists of 600 twist times/m (Z twists), as a ground yarn. The pile knitted fabric obtained thereby was dipped in hot water at 95° C. and the starch agent adhering to the textured spun yarn which forms the pile yarn was dissolved and removed. Thereafter, it was dried by the hot-air dryer at 150° C. Texture of the pile knitted fabric obtained thereby was evaluated based on the evaluation references as indicated in the above Table 3 with reference to a pile knitted fabric manufactured using the original single spun yarn as it was as the pile yarn in the same manner. The result thereof was as indicated in the following Table 4.

Examples 5 to 8 and Comparison Examples 6 to 10

(1) A 20 count single spun yarn ("combed yarn" manufactured by Indonesia SCS Corp.) made of 100% cotton fibers, which had the number of twists of 600 twist times/m (Z twists), was used as the single spun yarn. The number T of twists of the single spun yarn per 2.54 cm was 15.24 twist times and the count S was 20. Based on this, a twist coefficient K from the equation of $K=(T/\sqrt{S})$ was $15.24/\sqrt{20}=15.24/4.47=3.41$.

(2) The single spun yarn prepared in the above-mentioned process (1) was moved while being continuously dipped in a starch liquid tank with starch liquid composed of a 7 mass % aqueous solution or a 2 mass % aqueous solution of water-soluble polyvinyl alcohol ("SW-1" manufactured by Mizobata Chemical, Inc.) (the temperature of the starch liquid was 50° C.), or in a water tank with water (the temperature was 50° C.) containing no water-soluble polyvinyl alcohol in the single yarn form. Thereafter, it was taken out of the starch liquid tank or the water tank and was moved and dried while being wound around the surface of the rotating dry drum of which the surface temperature was 80° C. in a spiral form. Subsequently, it was steam-set with steam at 95° C. and was rolled up around the pipe. The adhesion amount of the starch agent in the single spun yarn obtained thereby (adhesion amount in the absolute dry state) was calculated by the above-mentioned method. The result thereof was as indicated in the following Table 4.

(3) The single spun yarn (dried single spun yarn) to which the starch agent adhered, which was obtained in the above-mentioned process (2), or a non-starched single spun yarn was supplied to the double twister ("36M" manufactured by Murata Machinery, Ltd.) and twisted in the opposite direction to the twisting direction of the single spun yarn by the number of twists as indicated in the following Table 4 so as to manufacture a textured spun yarn. Then, the textured spun yarn was steam-set with steam at the temperature of 95° C. and was rolled up around the pipe. The reverse twist properties in this case were evaluated based on the evaluation references as indicated in the above Table 1. The result thereof was as indicated in the following Table 4.

(4) In the textured spun yarn obtained in the above-mentioned process (3), a part of the textured spun yarn obtained by twisting the single spun yarn, to which the starch liquid was applied and which was dried, in the opposite direction to the twisting direction of the single spun yarn was rewound from the pipe in the skein form. Then, the textured spun yarn was dipped in hot water (temperature 90° C.) and the starch agent adhering thereto was dissolved and removed. After that, it was dried at 50° C. to create a textured spun yarn in which the starch agent was removed. Texture of the obtained textured spun yarn was evaluated based on the evaluation references as indicated in the above Table 2. The result thereof was as indicated in the following Table 4.

(5) An interlock fabric was knitted by the 14G circular knitting machine using the textured spun yarn in which the starch agent was removed, which was obtained in the above-mentioned process (4). Then, the obtained interlock knitted fabric was refined in a bath by the continuous refining machine at 95° C. and was dried by the hot-air dryer at 150° C. Texture of the interlock knitted fabric obtained thereby was evaluated based on the evaluation references as indicated in the above Table 3 with reference to an interlock knitted fabric obtained by knitting an interlock fabric by the 14G circular knitting machine using the original single spun yarn as it was, refining the obtained interlock knitted fabric in a bath by the continuous refining machine at 95° C., and drying it by the hot-air dryer at 150° C. The result thereof was as indicated in the following Table 4.

(6) A pile knitted fabric was manufactured by the 20G sinker piling machine (sinker length: 1.7 mm) using the textured spun yarn to which the starch agent adhered, which was obtained in the above-mentioned process (3), as a pile yarn and using the 20 count single spun yarn ("TS20 single yarn" manufactured by KB Tsuzuki K.K.) made of 100% cotton fibers, which had the number of twists of 600 twist times/m (Z twists), as a ground yarn. The pile knitted fabric obtained thereby was dipped in hot water at 95° C. and the starch agent adhering to the textured spun yarn forming the pile yarn was dissolved and removed. Thereafter, it was dried by the hot-air dryer at 150° C. Texture of the pile knitted fabric obtained thereby was evaluated based on the evaluation references as indicated in the above Table 3 with reference to a pile knitted fabric manufactured using the original single spun yarn as it was as the pile yarn in the same manner. The result thereof was as indicated in the following Table 4.

Examples 9 to 12 and Comparison Examples 11 to 15

(1) A 40 count single spun yarn ("combed yarn" manufactured by Indonesia SCS Corp.) made of 100% cotton fibers, which had the number of twists of 900 twist times/m (Z twists), was used as the single spun yarn. The number T of twists of the single spun yarn per 2.54 cm was 22.86 and the count S was 40. Based on this, a twist coefficient K from the equation of $K=(T/\sqrt{S})$ was $22.86/\sqrt{40}=22.86/6.32=3.62$.

(2) The single spun yarn prepared in the above-mentioned process (1) was moved while being continuously dipped in a starch liquid tank with starch liquid composed of a 8 mass % aqueous solution or a 2 mass % aqueous solution of water-soluble polyvinyl alcohol ("SW-1" manufactured by Mizobata Chemical, Inc.) (the temperature of the starch liquid was 50° C.), or in a water tank with water (the temperature was 50° C.) containing no water-soluble polyvinyl alcohol in the single yarn form. Thereafter, it was taken out of the starch liquid tank or the water tank and was moved and dried while being wound around the surface of the rotating dry drum of which the surface temperature was 80° C. in a spiral form. Subsequently, it was steam-set with steam at 95° C. and was rolled up around the pipe. The adhesion amount of the starch agent in the single spun yarn obtained thereby (adhesion amount in the absolute dry state) was calculated by the above-mentioned method. The result thereof was as indicated in the following Table 4.

(3) The single spun yarn (dried single spun yarn) to which the starch agent adhered, which was obtained in the above-mentioned process (2), or a non-starched single spun yarn was supplied to the double twister ("36M" manufactured by Murata Machinery, Ltd.) and twisted in the opposite direction to the twisting direction of the single spun yarn by the number of twists as indicated in the following Table 4 so as to manufacture a textured spun yarn. Then, the textured spun yarn was steam-set with steam at the temperature of 95° C. and rolled up around the pipe. The reverse twist properties in this case were evaluated based on the evaluation references as indicated in the above Table 1. The result thereof was as indicated in the following Table 4.

(4) In the textured spun yarn obtained in the above-mentioned process (3), a part of the textured spun yarn obtained by twisting the single spun yarn, to which the starch liquid was applied and which was dried, in the opposite direction to the twisting direction of the single spun yarn was rewound from the pipe in the skein form. Then, the textured spun yarn was dipped in hot water (temperature 90° C.) and the starch agent adhering thereto was dissolved and removed. After that, it was dried at 50° C. to create a textured spun yarn in which the starch agent was removed. Texture of the obtained textured spun yarn was evaluated based on the evaluation references as indicated in the above Table 2. The result thereof was as indicated in the following Table 4.

Figure 2:
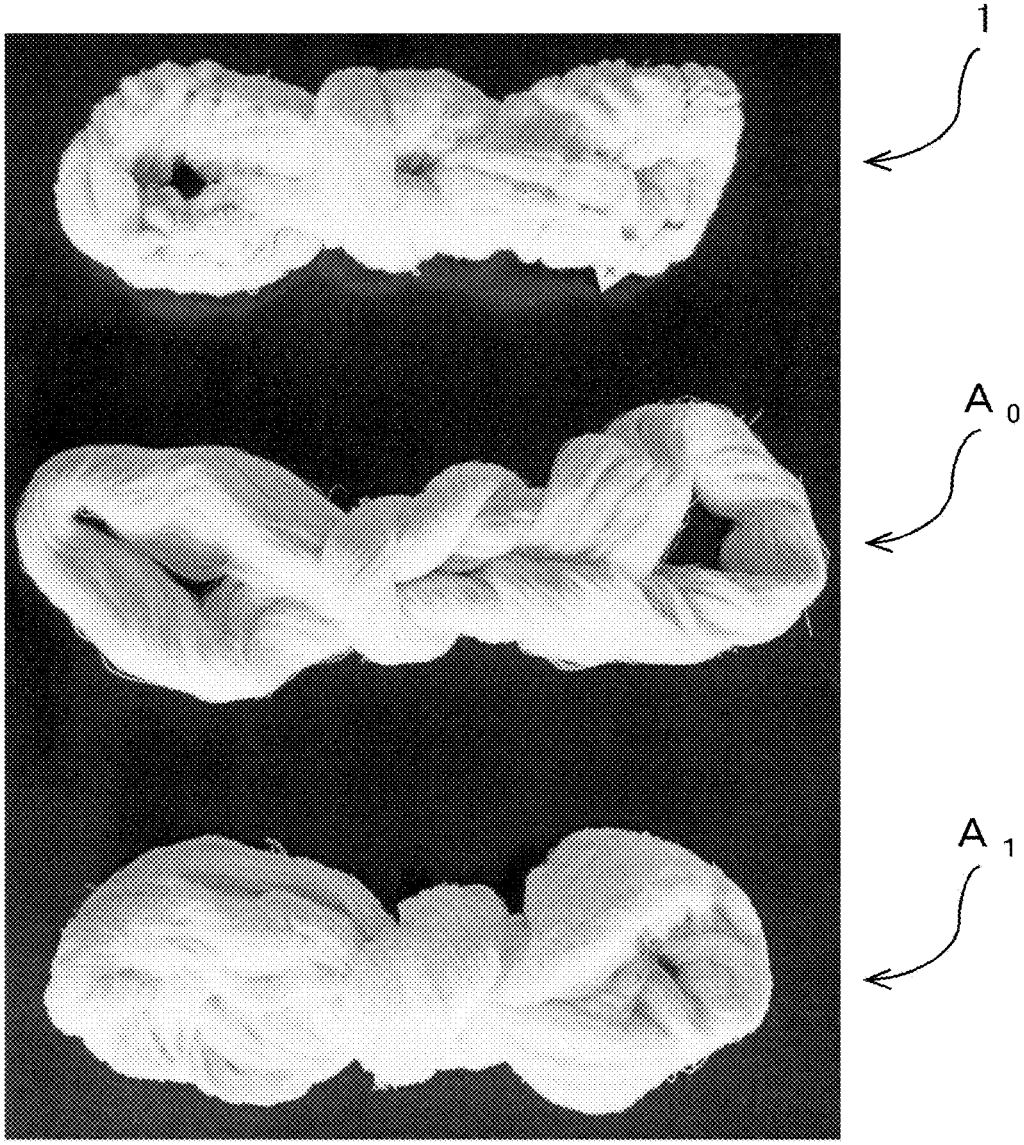
FIG. 2 An upper view in FIG. 2 is a picture of a single spun yarn (skein form) before being starched, which is used in Example 9, a middle view in FIG. 2 is a picture of the textured spun yarn ($A_0$) (skein form) obtained by twisting a single spun yarn after starched and dried in the opposite direction to the twisting direction of the single spun yarn, and a lower view in FIG. 2 is a picture of a textured spun yarn ($A_1$) (skein form) obtained by dissolving and removing the starch agent from the textured spun yarn ($A_0$) in water.
Figure 3:
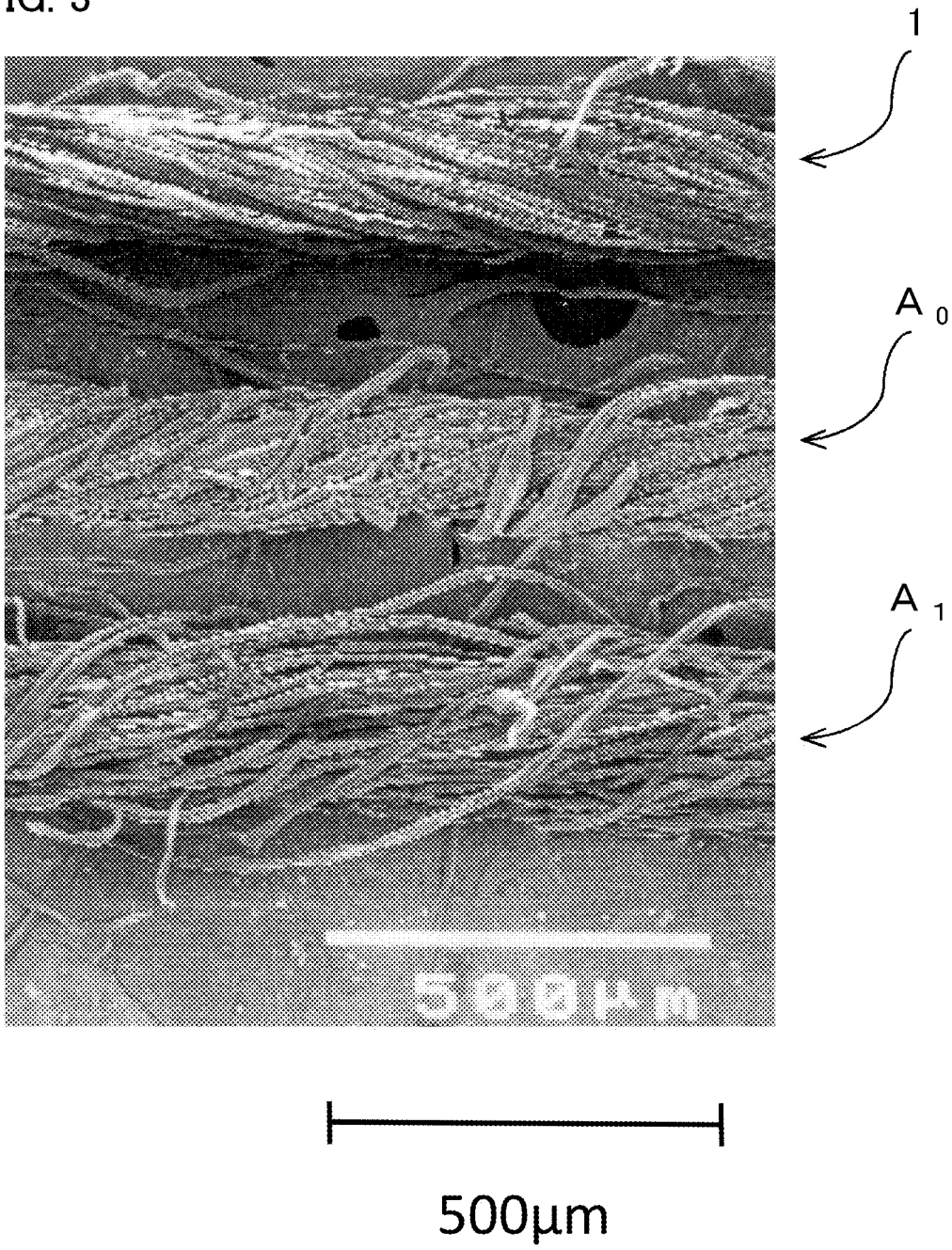
FIG. 3 An upper view in FIG. 3 is an electron micrograph of the single spun yarn (single yarn form) before being starched, which is used in Example 9, a middle view in FIG. 3 is an electron micrograph of the textured spun yarn ($A_0$) (single yarn form) obtained by twisting the single spun yarn after starched and dried in the opposite direction to the twisting direction of the single spun yarn, and a lower view in FIG. 3 is an electron micrograph of the textured spun yarn ($A_1$) (single yarn form) obtained by dissolving and removing the starch agent from the textured spun yarn ($A_0$) in water.

(5) FIG. 2 and FIG. 3 are photographs in the skein form (FIG. 2) and electron micrographs in the single yarn form (FIG. 3) of the single spun yarn before starched, which was used in Example 9 [upper views in FIG. 2 and FIG. 3], the "textured spun yarn ($A_0$) obtained by twisting the starched and dried single spun yarn in the opposite direction to the twisting direction of the single spun yarn", which was used in Example 9 [middle views in FIG. 2 and FIG. 3], and the textured spun yarn ($A_1$) obtained by dissolving and removing the starch agent in water from the textured spun yarn ($A_0$) [lower views in FIG. 2 and FIG. 3].

(6) An interlock fabric was knitted by the 14G circular knitting machine using the textured spun yarn in which the starch agent was removed, which was obtained in the above-mentioned process (4). Then, the obtained interlock knitted fabric was refined in a bath by the continuous refining machine at 95° C. and was dried by a hot-air dryer at 150° C. Texture of the interlock knitted fabric obtained thereby was evaluated based on the evaluation references as indicated in the above Table 3 in paragraph [0051] with reference to an interlock knitted fabric obtained by knitting an interlock fabric by the 14G circular knitting machine using the original single spun yarn as it was, refining the obtained interlock knitted fabric in a bath by the continuous refining machine at 95° C., and drying it by the hot-air dryer at 150° C. The result thereof was as indicated in the following Table 4.

(7) A pile knitted fabric was manufactured by the 20G sinker piling machine (sinker length: 1.7 mm) using the textured spun yarn to which the starch agent adhered, which was obtained in the above-mentioned process (3), as a pile yarn and using the 20 count single spun yarn ("TS20 single yarn" manufactured by KB Tsuzuki K.K.) made of 100% cotton fibers, which had the number of twists of 600 twist times/m (Z twists), as a ground yarn. The pile knitted fabric obtained thereby was dipped in hot water at 95° C. and the starch agent adhering to the textured spun yarn which forms the pile yarn was dissolved and removed. Thereafter, it was dried by the hot-air dryer at 150° C. Texture of the pile knitted fabric obtained thereby was evaluated based on the evaluation references as indicated in the above Table 3 in paragraph [0051] with reference to a pile knitted fabric manufactured using the original single spun yarn as it was as the pile yarn in the same manner. The result thereof was as indicated in the following Table 4.

TABLE 4

| | single spun yarn | | starch liquid | adhesion amount of | reverse twist | | ratio of | Texture | | |
|---|---|---|---|---|---|---|---|---|---|---|
| | count | number of twists (twisting direction) twist times/m | PVA concentration (mass %) | starch agent[1)] (mass %) | number of twists (twisting direction) twist times/m | reverse twist properties | number of twists[2)] | textured spun yarn[3)] | interlock knitted fabric[4)] | pile knitted fabric[5)] |
| Example 1 | 10 | 500 (Z) | 6 | 6.9 | 1000 (S) | ◎ | 2.0 | ◎ | ◎ | ◎ |
| Example 2 | 10 | 500 (Z) | 6 | 6.9 | 800 (S) | ◎ | 1.6 | ○ | ○ | ○ |
| Comparison Example 1 | 10 | 500 (Z) | 6 | 6.9 | 500 (S) | ◎ | 1 0 | Δ | Δ | Δ |
| Example 3 | 10 | 500 (Z) | 1.5 | 3.6 | 1000 (S) | ○ | 2.0 | ◎ | ◎ | ◎ |
| Example 4 | 10 | 500 (Z) | 1.5 | 3.6 | 800 (S) | ○ | 1.6 | ○ | ○ | ○ |
| Comparison Example 2 | 10 | 500 (Z) | 1.5 | 3.6 | 500 (S) | ○ | 1.0 | Δ | Δ | Δ |
| Comparison Example 3 | 10 | 500 (Z) | 0 | 0 | 1000 (S) | X | 2.0 | —[6)] | —[6)] | —[6)] |
| Comparison Example 4 | 10 | 500 (Z) | 0 | 0 | 800 (S) | X | 1.6 | —[6)] | —[6)] | —[6)] |
| Comparison Example 5 | 10 | 500 (Z) | 0 | 0 | 500 (S) | X | 1.0 | —[6)] | —[6)] | —[6)] |
| Example 5 | 20 | 600 (Z) | 7 | 5.3 | 1200 (S) | ◎ | 2.0 | ◎ | ◎ | ◎ |
| Example 6 | 20 | 600 (Z) | 7 | 5.3 | 1000 (S) | ◎ | 1.7 | ◎ | ○ | ○ |
| Comparison Example 6 | 20 | 600 (Z) | 7 | 5.3 | 600 (S) | ◎ | 1.0 | Δ | Δ | Δ |
| Example 7 | 20 | 600 (Z) | 2 | 1.2 | 1200 (S) | ○ | 2.0 | ◎ | ◎ | ◎ |
| Example 8 | 20 | 600 (Z) | 2 | 1.2 | 1000 (S) | ○ | 1.7 | ○ | ○ | ○ |
| Comparison Example 7 | 20 | 600 (Z) | 2 | 1.2 | 600 (S) | ○ | 1 0 | Δ | Δ | Δ |
| Comparison Example 8 | 20 | 600 (Z) | 0 | 0 | 1200 (S) | X | 2.0 | —[6)] | —[6)] | —[6)] |

TABLE 4-continued

| | single spun yarn | | starch liquid | adhesion amount of | reverse twist | | ratio of | Texture | | |
|---|---|---|---|---|---|---|---|---|---|---|
| | count | number of twists (twisting direction) twist times/m | PVA concentration (mass %) | starch agent[1)] (mass %) | number of twists (twisting direction) twist times/m | reverse twist properties | number of twists[2)] | textured spun yarn[3)] | interlock knitted fabric[4)] | pile knitted fabric[5)] |
| Comparison Example 9 | 20 | 600 (Z) | 0 | 0 | 1000 (S) | X | 1.7 | —[6)] | —[6)] | —[6)] |
| Comparison Example 10 | 20 | 600 (Z) | 0 | 0 | 600 (S) | X | 1.0 | —[6)] | —[6)] | —[6)] |
| Example 9 | 40 | 900 (Z) | 8 | 8.8 | 1800 (S) | ◎ | 2 0 | ◎ | ◎ | ◎ |
| Example 10 | 40 | 900 (Z) | 8 | 8.8 | 1500 (S) | ◎ | 1.7 | ◎ | ○ | ○ |
| Comparison Example 11 | 40 | 900 (Z) | 8 | 8.8 | 900 (S) | ◎ | 1.0 | Δ | Δ | Δ |
| Example 11 | 40 | 900 (Z) | 2 | 2.2 | 1800 (S) | ○ | 2.0 | ◎ | ◎ | ◎ |
| Example 12 | 40 | 900 (Z) | 2 | 2.2 | 1500 (S) | ○ | 1.7 | ○ | ○ | ○ |
| Comparison Example 12 | 40 | 900 (Z) | 2 | 2.2 | 900 (S) | ○ | 1.0 | Δ | Δ | Δ |
| Comparison Example 13 | 40 | 900 (Z) | 0 | 0 | 1800 (S) | X | 2.0 | —[6)] | —[6)] | —[6)] |
| Comparison Example 14 | 40 | 900 (Z) | 0 | 0 | 1500 (S) | X | 1.7 | —[6)] | —[6)] | —[6)]; |
| Comparison Example 15 | 40 | 900 (Z) | 0 | 0 | 900 (S) | X | 1.0 | —[6)] | —[6)] | —[6)] |

[1)]An adhesion amount of a starch agent in a single spun yarn in an absolute dry state (mass %)

[2)]A ratio of the number of twists of the revers twists relative to the number of twists of the single spun yarn (factor)

[3)]Texture of a textured spun yarn obtained by dissolving and removing the starch agent in water from a textured spun yarn obtained by reversely twisting a starched and dried single spun yarn

[4)]Texture of an interlock knitted fabric knitted using the textured spun yarn obtained by dissolving and removing the starch agent in water from the textured spun yarn obtained by reversely twisting the starched and dried single spun yarn

[5)]Texture of a pile knitted fabric obtained by dissolving and removing the starch agent in water from a pile portion after a pile knitted fabric is manufactured using the textured spun yarn obtained by reversely twisting the starched and dried single spun yarn as a pile yarn

[6)]Incapable of being evaluated because the textured spun yarn could not be obtained due to failure at the time of reverse twist As is seen from the above Table 4, in Examples 1 to 12, the textured spun yarn [textured spun yarn ($A_0$)] was manufactured by twisting the starched and dried single spun yarn in the opposite direction to the twisting direction of the single spun yarn by the number of twists which was 1.3 to 3 times the number of twists of the single spun yarn. Then, the interlock knitted fabric was manufactured using the textured spun yarn [textured spun yarn ($A_1$)] obtained by dissolving and removing the starch agent in water from the textured spun yarn [textured spun yarn ($A_0$)], or the pile knitted fabric was manufactured using the textured spun yarn [textured spun yarn ($A_0$)] before removing the starch agent, and then, the starch agent was dissolved and removed with water. With this, the woven or knitted fabric (knitted fabric) that swelled largely, and was soft and had preferable texture was provided. This is also obvious from the photographs in FIG. 2 and FIG. 3.

On the other hand, in Comparison Examples 3 to 5, 8 to 10, and 13 to 15, the single spun yarn was twisted in the opposite direction to the twisting direction thereof without being starched. Due to this, yarn breakage occurred while the single spun yarn was set to the twisting machine for the reverse twisting, resulting in failure to obtain the reversely twisted textured spun yarn. In Comparison Examples 1, 2, 6, 7, 11, and 12, the starched and dried single spun yarn was twisted in the opposite direction to the twisting direction thereof, thereby reversely twisting it without yarn breakage. However, the number of twists at the time of the reverse twist was lower than 1.3 times the number of twists of the spun yarns. Due to this, the interlock knitted fabric manufactured using the textured spun yarn obtained by removing the starch agent from the textured spun yarn obtained by the reverse twist and the pile knitted fabric obtained by dissolving and removing the starch agent in water after the pile knitted fabric was manufactured using the textured spun yarn [textured spun yarn ($A_0$)] before removing the starch agent did not swell sufficiently and lacked softness with it.

Both of the textured spun yarn ($A_0$) according to the invention and the textured spun yarn ($A_1$) according to the invention obtained by dissolving and removing the starch agent in water from the textured spun yarn can be used as yarns for weaving or knitting with no problem. Further, both of the woven or knitted fabric ($B_1$) obtained by performing weaving or knitting using the textured spun yarn ($A_1$) and the woven or knitted fabric ($B_2$) obtained by manufacturing a woven or knitted fabric using the textured spun yarn ($A_0$) and removing the starch agent in water from the woven or knitted fabric largely swell, are soft and excellent in texture, are excellent in the air permeability, the heat-insulating properties, and the water absorbency, and shed no fluff in comparison with a woven or knitted fabric obtained by using an original single spun yarn. Therefore, they can be effectively used for wide applications towels, sports clothes, underwear, foundations, jeans, outer clothes, other clothes, medical purposes such as elastic wraps, vehicle interior materials, belt conveyor fabrics, other industrial materials, and the like, for example, while utilizing these excellent characteristics.

What is claimed is:

1. A textured spun yarn manufacturing method comprising at least:

starching a single spun yarn in a single yarn form having a number of twists with starch liquid prepared by dissolving a starch agent containing a water-soluble polymer in water to provide a starched single spun yarn;

drying the starched single spun yarn to provide a starched and dried single spun yarn; and twisting the starched and dried single spun yarn in a single yarn form in an opposite direction to a twisting direction of the single spun yarn by a number of twists which ranges from 1.4 to 3 times the number of twists of the single spun yarn to provide the textured spun yarn.

2. A textured spun yarn manufacturing method according to claim 1, further comprising: dissolving and removing the starch agent from the textured spun yarn in water.

3. A textured spun yarn manufacturing method according to claim 1 wherein the starched and dried single spun yarn is twisted in an opposite direction to the twisting direction of the single spun yarn by the number of twists which ranges from 1.5 to 3 times the number of twists of the single spun yarn.

4. A textured spun yarn manufacturing method according to claim 3 further comprising: dissolving and removing the starch agent from the textured spun yarn in water.

5. A textured spun yarn manufacturing method according to claim 1 wherein the starched and dried single spun yarn is twisted in an opposite direction to the twisting direction of the single spun yarn by the number of twists which ranges from 1.6 to 3 times the number of twists of the single spun yarn.

6. A textured spun yarn manufacturing method according to claim 5 further comprising: dissolving and removing the starch agent from the textured spun yarn in water.

7. A woven or knit fabric manufacturing method comprising performing weaving or knitting at least using a textured spun yarn so as to manufacture a woven or knit fabric, wherein the textured spun yarn is manufactured by a method comprising at least:

starching a single spun yarn in a single yarn form having a number of twists with starch liquid prepared by dissolving a starch agent containing a water-soluble polymer in water to provide a starched single spun yarn;

drying the starched single spun yarn in a single yarn form to provide a starched and dried single spun yarn;

twisting the starched and dried single spun yarn in a single yarn form in an opposite direction to a twisting direction of the single spun yarn by a number of twists which ranges from 1.4 to 3 times the number of twists of the single spun yarn to provide the textured spun yarn.

8. A woven or knit fabric manufacturing method according to claim 7, further comprising: dissolving and removing the starch agent from the textured spun yarn forming the woven or knit fabric in water.

9. A woven or knit fabric manufacturing method according to claim 7, further comprising: dissolving and removing the starch agent from the textured spun yarn in water before performing weaving or knitting to manufacture the woven or knit fabric.

* * * * *